US006590364B2

(12) United States Patent
Rogers, III et al.

(10) Patent No.: US 6,590,364 B2
(45) Date of Patent: Jul. 8, 2003

(54) POWER KIT ASSEMBLY FOR A HEIGHT ADJUSTABLE CHAIR

(75) Inventors: M. Weldon Rogers, III, St. Louis, MO (US); Robert A. Eberle, Kansas City, MO (US); Joseph M. Mooney, Florissant, MO (US); David L. Schwartz, Creve Coeur, MO (US)

(73) Assignee: EAC Corporation, St. Louis, MO (US)

( * ) Notice: Subject to any disclaimer, the term of this patent is extended or adjusted under 35 U.S.C. 154(b) by 0 days.

(21) Appl. No.: 09/878,448

(22) Filed: Jun. 11, 2001

(65) Prior Publication Data

US 2002/0101105 A1 Aug. 1, 2002

Related U.S. Application Data

(60) Provisional application No. 60/263,407, filed on Jan. 23, 2001, and provisional application No. 60/257,066, filed on Dec. 20, 2000.

(51) Int. Cl.[7] ..... H01M 10/46

(52) U.S. Cl. ..... 320/107; 297/217.3; 297/344.2

(58) Field of Search ..... 320/107, 112, 320/113; 297/217.1, 217.3, 217.5, 217.7, 344.17, 344.23, 344.2

(56) References Cited

U.S. PATENT DOCUMENTS 4,139,175 A * 2/1979 Bauer
5,975,630 A * 11/1999 Schreiber
6,113,188 A * 9/2000 Stewart et al.

* cited by examiner

*Primary Examiner*—Edward H. Tso
(74) *Attorney, Agent, or Firm*—Robert B. Reeser, III; Armstrong Teasdale LLP

(57) ABSTRACT

A power kit assembly for an adjustable chair that provides power to a height adjustment mechanism to enable a chair to be adjusted electrically in a cost effective and reliable manner is described. The chair includes a limit switch that limits an amount of movement of the height adjustment mechanism. The power kit assembly includes a battery pack electrically and removably coupled to an electric motor and to the limit switch. The electric motor is coupled to the height adjustment mechanism. The battery pack includes at least one battery cell and a housing. The battery cells are axially-aligned within the battery pack housing and extend between first and second ends of the housing. The battery cells are also rechargeable.

10 Claims, 8 Drawing Sheets

POWER KIT ASSEMBLY FOR A HEIGHT ADJUSTABLE CHAIR

CROSS REFERENCE TO RELATED APPLICATIONS

This application claims the benefit of U.S. Provisional Application No. 60/257,066 filed Dec. 20, 2000, and U.S. Provisional Application No. 60/263,407 filed Jan. 23, 2001.

BACKGROUND OF THE INVENTION

This application relates generally to adjustable chairs, and more particularly to height adjustment mechanisms used with adjustable chairs.

Office chairs typically include a chair back, a chair seat, and a base that supports the chair. The chair back is coupled to the chair seat, and the chair seat is coupled to the chair base. More specifically, a column extends between the base and the chair seat to support the chair seat. At least some known chair bases include casters or glides that enable the chair base to be in freely-rollable or freely-glidable contact with a floor.

Sitting in a chair at an improper height for prolonged periods of time may increase the discomfort and fatigue to the occupant. To facilitate improving a comfort level of seated occupants, at least some chairs include chair backs including adjustment mechanisms that permit the chair back to be variably positioned with respect to the chair seat, and permit the chair seat to be variably positioned with respect to the chair base. More specifically, at least some known chairs include an adjustable column that permits a user to vary a height of the chair seat relative to the chair base.

At least some known adjustable columns are coupled to the chair seat with threaded connections. The threaded connections permit the chair seat to rotate to adjust the relative height of the seat. As a result, when an occupant rotates the chair seat relative to the chair base, the height of the seat relative to the floor is changed.

To permit rotation of the chair seat without adjustments being made to the relative height of the chair, at least some other known adjustable columns are rotatably coupled to the chair base with swivel fixtures that permit the chair seat to rotate without changing the height of the chair relative to the floor. Such columns also include pneumatic cylinders which permit the relative height of the chair to be manually changed. However, often the adjustments can not be made while the occupant is seated, and as a result, an adjustment process can be time-consuming and tedious as the occupant must often make numerous trial adjustments finding a chair seat position that is at a height relative to the floor that is comfortable to the occupant.

SUMMARY OF THE INVENTION

In an exemplary embodiment, a power kit assembly for an adjustable chair provides power to a height adjustment mechanism to enable a chair to be adjusted electrically in a cost effective and reliable manner. The chair includes a limit switch that limits an amount of movement of the height adjustment mechanism. The power kit assembly includes a battery pack electrically coupled to an electric motor and to the limit switch. The electric motor is coupled to the height adjustment mechanism. The battery pack includes a plurality of battery cells and a housing. The battery cells are axially-aligned within the battery pack housing and extend between first and second ends of the housing. The battery cells are also rechargeable.

During use, a seated occupant may electrically raise or lower the chair seat relative to a chair base. When the electric motor is activated, the battery pack supplies power to the motor. Because the battery pack is removably coupled to the chair, when the power supply to the batteries decreases after use, the battery pack may be easily removed such that the battery cells may be recharged. As a result, the battery pack supplies power to the electric motor in a cost-effective and reliable manner.

DETAILED DESCRIPTION OF THE INVENTION

Figure 1:
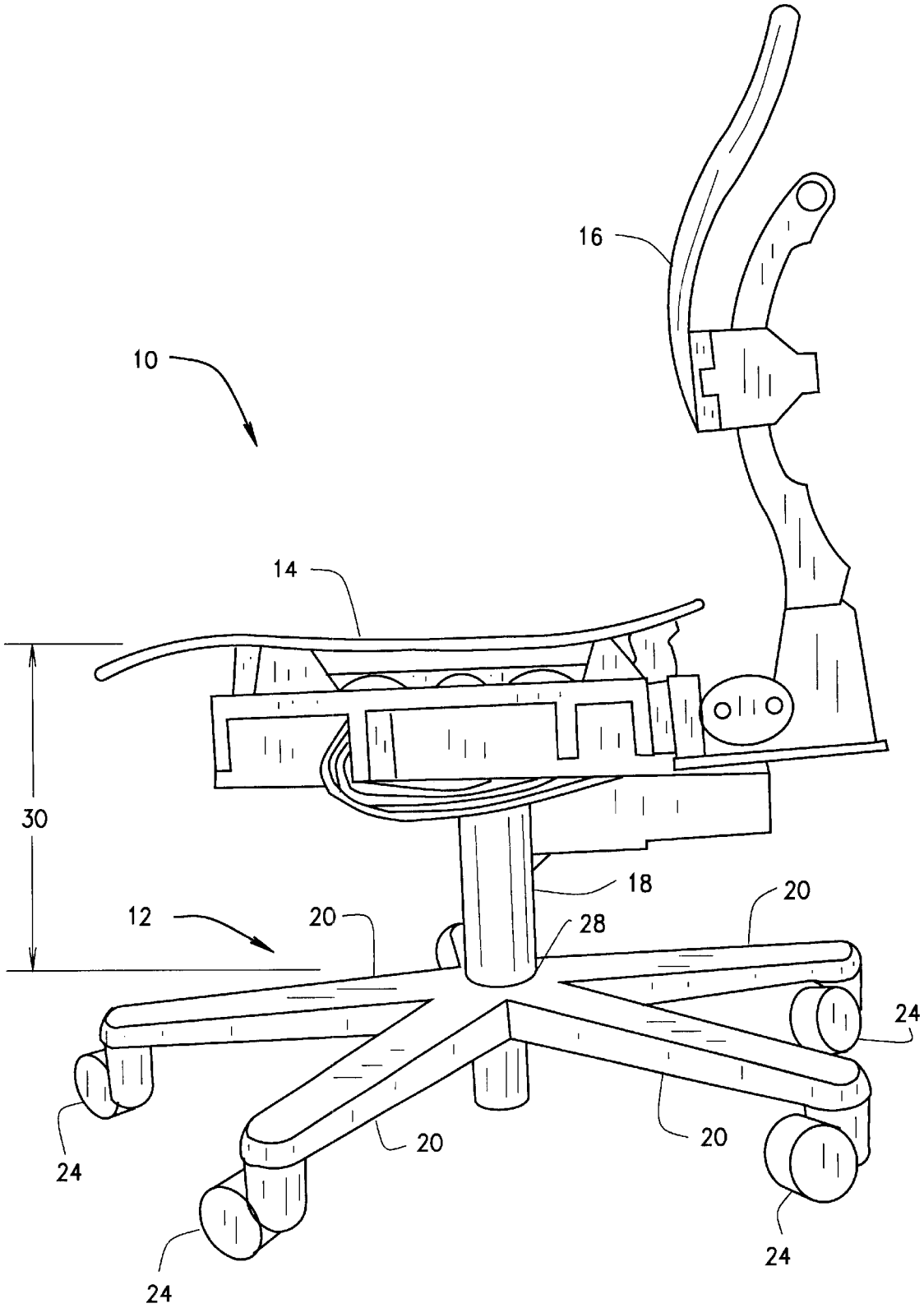
FIG. 1 is side view of an adjustable chair.

FIG. 1 is a side view of an adjustable chair 10. In one embodiment, chair 10 is an office chair. Chair 10 includes a base 12, a seat 14, a back assembly 16, and a height adjustment mechanism 18. Chair back assembly 16 is coupled to chair seat 14, and chair base 12 supports chair 10.

Chair base 12 is known in the art and is a pedestal support base that includes a plurality of legs 20 arranged in a conventional star-shaped arrangement. In one embodiment, base 12 includes five legs 20. Alternatively, base 12 includes more or less than five legs. Each leg 20 includes a caster 24, such that chair 10 is in free-rolling contact with a floor (not shown). In an alternative embodiment, chair legs 20 do not include casters 24.

Base legs 20 support chair 10 and extend from casters 24 to a center socket 28. Socket 28 includes an opening (not shown in FIG. 1) extending therethrough and sized to receive height adjustment mechanism 18. Height adjustment mechanism 18 extends through base center socket 28, and is substantially perpendicular to base 12. More specifically, height adjustment mechanism 18 extends between base 12 and chair 10 and includes a drive mechanism (not shown in FIG. 1) for adjusting a height 30 of chair seat 14 relative to chair base 12.

Figure 2:
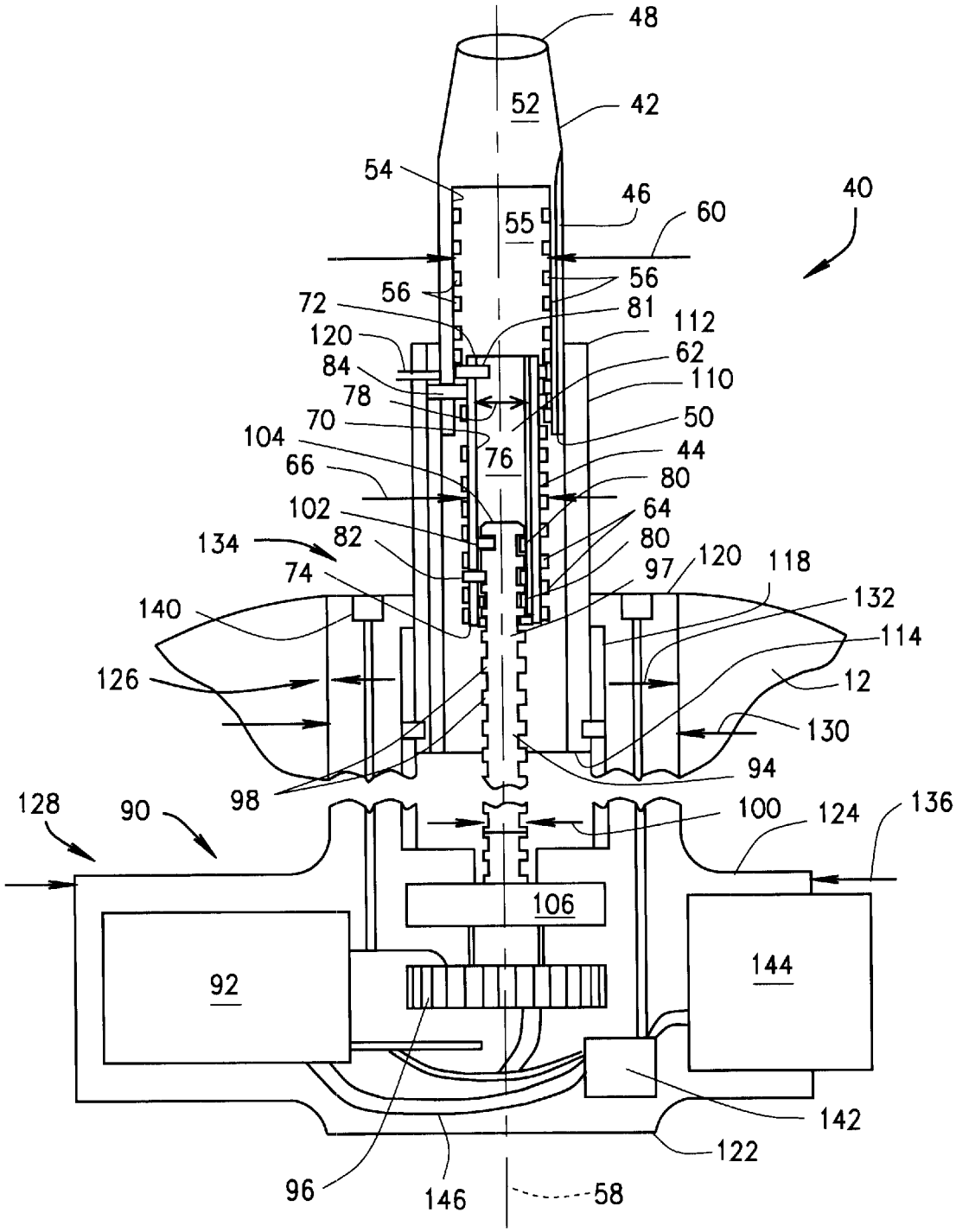
FIG. 2 is a partial cross-sectional side view of a height adjustment mechanism that may be used with the chair shown in FIG. 1.

FIG. 2 is a partial cross-sectional side view of a height adjustment mechanism 40 that may be used with chair 10 shown in FIG. 1. Height adjustment mechanism 40 includes an upper enclosure member 42 telescopically coupled to a lower enclosure member 44. More specifically, lower enclosure member 44 is coupled substantially co-axially to upper enclosure member 42 such that lower enclosure member 44 telescopes into upper enclosure member 42. Upper enclosure member 42 is coupled between chair seat 14 (shown in FIG. 1) and lower enclosure member 44. Lower enclosure member 44 is coupled between upper enclosure member 42 and chair base 12. In one embodiment, upper enclosure member 42 has a substantially circular cross-sectional profile.

Upper enclosure member 42 includes a hollow guide sleeve 46, an upper end 48, and a lower end 50. In addition, upper enclosure member 42 includes an outer surface 52 and an inner surface 54. Upper enclosure member upper end 48 is tapered to be frictionally fit within a receptacle (not shown) extending from chair seat 14. Upper enclosure member inner surface 54 defines a cavity 55 and includes a plurality of threads 56 that extend radially inward from inner surface 54 towards an axis of symmetry 58 for height adjustment mechanism 40. Axis of symmetry 58 extends from upper enclosure member first end 48 to upper enclosure second end 50. Upper enclosure member threads 56 extend along inner surface 54 from upper enclosure member lower end 50 towards upper end 48. In one embodiment, upper enclosure member 42 includes a spring (not shown) mounted to provide a pre-determined amount of downward travel of chair seat 14 when chair seat 14 is initially occupied.

Upper enclosure member cavity 55 has a diameter 60 measured with respect to inner surface 54 sized to receive lower enclosure member 44 therein. More specifically, lower enclosure member 44 is hollow and includes an outer surface 62 including a plurality of threads 64 which extend radially outward from outer surface 62. In addition, lower enclosure member 44 has an outer diameter 66 that is smaller than upper enclosure cavity diameter 55. More specifically, upper enclosure member cavity 55 and lower enclosure member 44 are sized such that as lower enclosure member 44 is received within upper enclosure member cavity 55, lower enclosure member threads 64 engage upper enclosure member threads 66.

Lower enclosure member 44 also includes an inner surface 70 that extends from an upper end 72 of lower enclosure member 44 to a lower end 74 of lower enclosure member 44. Threads 64 extend between upper and lower ends 72 and 74, respectively. Lower enclosure member inner surface 70 defines a cavity 76 that has a diameter 78 measured with respect to inner surface 70. A plurality of threads 81 extend radially inward from inner surface 70 between lower enclosure member upper and lower ends 72 and 74, respectively.

Lower enclosure member 44 also includes an upper stop 81 and a lower stop 82. Lower enclosure member upper stop 81 is adjacent lower enclosure upper end 72. As lower enclosure member 44 rotates within upper enclosure member 42, lower enclosure upper stop 81 contacts an upper enclosure member stop 84 to limit a distance that upper enclosure member 42 may extend towards chair seat 14 from chair base 12. Lower enclosure member lower stop 82 is adjacent lower enclosure lower end 74 and limits a distance that lower enclosure member 44 may extend towards chair seat 14 from chair base 12. Stops 81 and 82 prevent height adjustment mechanism 40 from over-rotating as chair seat 14 is raised and becoming forcibly stuck in a relative extended position that has exceeded a pre-determined fully-extended position.

Lower enclosure member 44 is coupled to base 12 through a drive mechanism 90. Drive mechanism 90 includes an electric motor 92, a drive shaft 94, and a gear box 96. Electric motor 92 is coupled to gear box 96 which in turn is coupled to drive shaft 94. Electric motor 92 is known in the art and in one embodiment is commercially available from Dewert Motorized Systems, Frederick, Md., 21704-4300. More specifically, electric motor 92 and gear box 96 are coupled substantially perpendicularly to drive shaft 94. Drive shaft 94 is substantially co-axial with respect to upper and lower enclosure members 42 and 44, respectively.

Drive shaft 94 includes an outer surface 97 including a plurality of threads 98 extending radially outward from outer surface 97. Drive shaft 94 has an outer diameter 100 measured with respect to outer surface 97 that is smaller than lower enclosure member cavity diameter 78. More specifically, drive shaft diameter 100 is sized such that when drive shaft 94 is received within lower enclosure member 42, drive shaft threads 98 engage lower enclosure inner threads 80. Drive shaft 94 also includes a stop 102 adjacent to an upper end 104 of drive shaft 94. As drive shaft 94 rotates within lower enclosure member 44, lower enclosure member 44 is rotated within upper enclosure member 42 to raise or lower upper enclosure member 42 with respect to chair base 12. When upper enclosure member 42 is being raised, drive shaft stop 102 contacts lower enclosure member lower stop 82 to limit a distance that lower enclosure member 44 may extend towards chair seat 14 from chair base 12. Drive shaft 94 also includes a lower end 104 coupled to gear box 96. A load bearing 106 extends circumferentially around drive shaft 94 between gear box 96 and lower enclosure member 44.

A hollow guide sleeve 110 extends circumferentially around upper and lower enclosure members 42 and 44, and drive shaft 94. More specifically, guide sleeve 110 is co-axially aligned with respect to upper and lower enclosure members 42 and 44, and drive shaft 94, and has a first end 112 and a second end 114. Guide sleeve 110 has a height (not shown) such that guide sleeve first end 112 is between upper enclosure member upper and lower ends 48 and 50, respectively, and guide sleeve second end 114 is in proximity to gear box 96, such that load bearing 106 is between guide sleeve second end 114 and gear box 96.

Guide sleeve 110 also includes an anti-spin and side load collar 118, and an upper stop 120. During rotation of lower enclosure member 44, guide sleeve upper stop 120 works in combination with lower enclosure upper stop 81 and upper enclosure stop 84 to limit a distance that upper enclosure member 42 may extend towards chair seat 14 from chair base 12. Anti-spin and side load collar 118 includes channels (not shown) that extend lengthwise along guide sleeve 110 to prevent guide sleeve 110 from rotating as chair seat 14 is rotated. More specifically, because upper enclosure member 42 is frictionally coupled beneath chair seat 14, as chair seat 14 is rotated, upper enclosure member 42 rotates simultaneously with chair seat 14, and induces rotation into lower enclosure member 44. Anti-spin and side load collar 118 permits chair seat 14 to rotate without permitting guide sleeve 110 to rotate. In addition, as an occupant sits and moves around within chair seat 14, side loading forces induced into upper and lower enclosure members 42 and 44, respectively, are transmitted through guide sleeve 110 and anti-spin and side load collar 118 into chair base 12.

Anti-spin and side load collar 118 extends around guide sleeve 110 between guide sleeve 110 and a housing 124.

Housing 124 has an upper surface 120 and a lower surface 122, and extends around guide sleeve 110 and anti-spin and side load collar 118. Housing 124 includes an upper portion 126 and a lower portion 128. Upper portion 126 is substantially circular and has an inner diameter 130 that is smaller than an outer diameter 132 of an opening 134 extending through base socket 28. Housing lower portion 128 has an outer diameter 136 that is larger than base socket opening 134.

A plurality of sensors 140 are mounted to housing upper surface 120 and receive signals from a switch (not shown) attached to chair seat 14. Sensors 140 detect when a predetermined amount of resistance is induced into height adjustment mechanism 40 as chair seat 14 is raised. More specifically, sensors 140 are coupled to drive mechanism 90 and stop operation of electric motor 92 when a predetermined amount of resistance is sensed. In one embodiment, sensors 140 are infrared sensors and receive an infrared signal transmitted from an infrared switch attached to chair seat 14. In a further embodiment, sensors 140 are commercially available from Dewert Motorized Systems, Frederick, Md., 21704.

Sensors 140 are coupled to a limit or resistance sensing switch 142. Limit switch 142 receives a signal from sensors 140 regarding a relative position of drive shaft 94 measured with respect to chair base 14. More specifically, limit switch 142 is electrically coupled to electric motor 92 and automatically stops a flow of electric current to motor 92 when drive shaft 94 nears a pre-set fully extended position.

Drive mechanism 90 is housed within housing 124 and is electrically coupled to a battery pack 144 including rechargeable battery cells (not shown in FIG. 2). In the exemplary embodiment, battery pack 144 has a substantially rectangular cross-sectional profile. Alternatively, battery pack 144 has a non-rectangular cross-sectional profile. More specifically, a plurality of wires 146 couple battery pack 144 to electric motor 92 to permit battery pack 144 to supply power to motor 92. In addition, electric motor 92 is also coupled to a resistance sensing switch (not shown) which automatically stops a flow of electric current to motor 92 when a pre-determined amount of resistance is induced within height adjustment mechanism 40 as chair seat height 30 (shown in FIG. 1) is adjusted. For example, the resistance sensing switch automatically stops a flow of electric current to motor 92 to prevent an occupant's legs (not shown) from being compressed between chair seat 14 and an underside (not shown) of a desk or table (not shown) as seat 14 is raised.

The battery pack battery cells are removably coupled within housing 124. In another embodiment, battery pack 144 is mounted separately from housing 124 to facilitate removal and replacement of the battery cells for recharging purposes. The battery cells may be, but are not limited to, a lead acid battery, a nickel metal hydride battery, a nickel cadmium battery, a lithium ion battery, or a lithium ion polymer battery. In one embodiment, a battery life indicator (not shown) is coupled to battery pack 144 to indicate when a useful life of battery pack battery cells is decreasing and requires recharging.

During assembly, height adjustment mechanism 40 is initially assembled. More specifically, upper enclosure member 42 is coupled to lower enclosure member 44, and the assembly is inserted within housing 124. Limit switch 142 is coupled to either the upper enclosure member 42 or the lower enclosure member 44, and to electric motor 92.

Drive mechanism 90 is then coupled to lower enclosure member 44, and inserted within housing 124. More specifically, gear box 96 is coupled to drive shaft 94, and motor 92 is then coupled to gear box 96. Battery pack 144 is then coupled to motor 92 and inserted within housing 124.

Height adjustment mechanism 40 is then inserted within chair base socket 28 such that sensors 140 are in alignment with the switch sensor mounted on chair seat 14. Wires (not shown) are routed to a control mechanism switch (not shown) that is accessible by an occupant sitting in chair seat 14 for selectively adjusting chair seat height 30 with respect to chair base 12.

When the seated occupant engages the control mechanism switch to raise chair seat 14 relative to chair base 12, electric motor 92 operates to rotate gear box 96. In one embodiment, the control mechanism switch incorporates the battery life indicator. In an alternative embodiment, housing 124 incorporates the battery life indicator. Because gear box 96 is coupled to drive shaft 94, drive shaft 94 rotates simultaneously with gear box 96. As drive shaft 94 is rotated, drive shaft threads 98 engage lower enclosure inner threads 80 and cause lower enclosure member 44 to rotate. As lower enclosure member 44 rotates, lower enclosure member outer threads 64 engage upper enclosure member threads 66 to cause upper enclosure member 42 to rotate, thus raising chair seat 14 relative to chair base 12.

Figure 3:
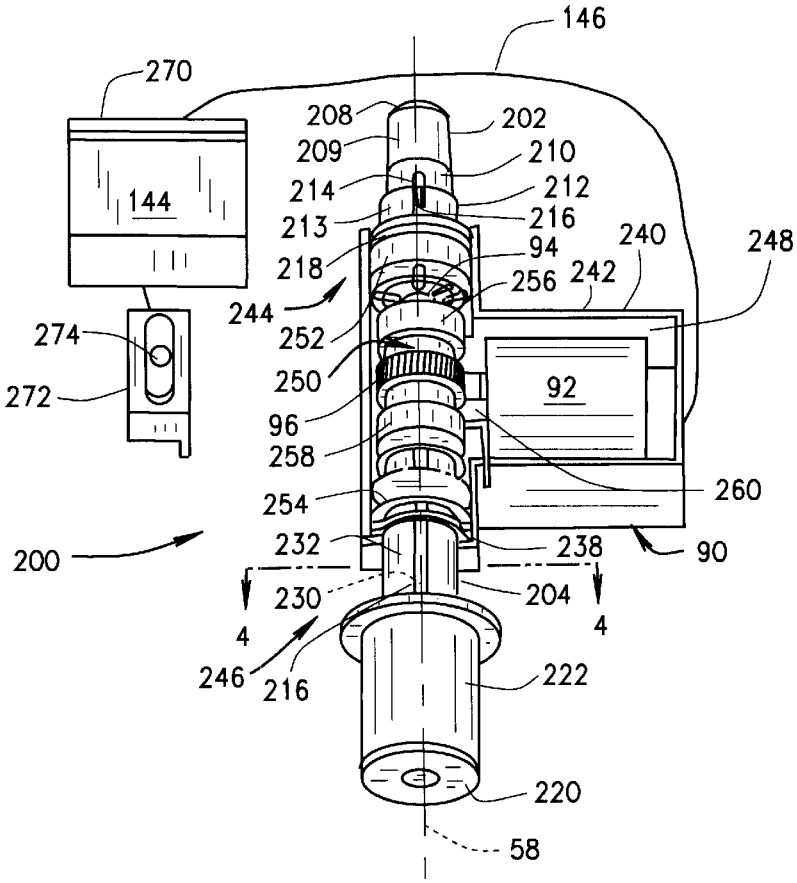
FIG. 3 is a partial cut-away side view of an alternative embodiment of a height adjustment mechanism that may be used with the chair shown in FIG. 1.

FIG. 3 is a partial cut-away side view of an alternative embodiment of a height adjustment mechanism 200 that may be used with chair 10 (shown in FIG. 1). Height adjustment mechanism 200 is similar to height adjustment mechanism 40, shown in FIG. 2, and components in height adjustment mechanism 200 that are identical to components of height adjustment mechanism 40 are identified in FIG. 3 using the same reference numerals used in FIG. 2. Accordingly, height adjustment mechanism 200 includes drive mechanism 90, including electric motor 92, drive shaft 94, and gear box 96. In addition, height adjustment mechanism 200 also includes an upper enclosure member 202 telescopically coupled to a lower enclosure member 204. More specifically, lower enclosure member 204 is coupled substantially co-axially to upper enclosure member 202 such that lower enclosure member 204 telescopes into upper enclosure member 202. Upper enclosure member 202 is coupled between chair seat 14 (shown in FIG. 1) and lower enclosure member 204. Lower enclosure member 204 is coupled between upper enclosure member 202 and chair base 12 (shown in FIG. 1). In one embodiment, upper enclosure member 202 and lower enclosure member 204 each have a substantially circular cross-sectional profile. In an alternative embodiment, upper enclosure member 202 and lower enclosure member 204 have non-circular cross sectional profiles.

Upper enclosure member 202 includes an upper end 208 and a lower end (not shown). Upper enclosure member upper end 208 is tapered to be frictionally fit within a receptacle (not shown) extending from chair seat 14. More specifically, upper enclosure member upper end 208 includes a chair control taper end 209. Chair control taper ends 209 are known in the art. In one embodiment, upper enclosure member upper end 208 also includes a spring (not shown) mounted in such a manner as to provide a predetermined amount of downward travel of chair seat 14 when chair seat 14 is initially occupied.

Upper enclosure member 202 includes a screw collar 210 and an anti-screw collar 212. In one embodiment, screw collar 210 and anti-screw collar 212 each have non-circular cross-sectional profiles. In an alternative embodiment, screw collar 210 and anti-screw collar 212 each have substantially circular cross-sectional profiles. In a further embodiment, screw collar 210 has a substantially round cross-sectional profile and anti-screw collar 212 has a substantially round inner cross-sectional profile defined by an inner surface (not shown) of anti-screw collar 212, and a non-circular outer cross sectional profile defined by an outer surface 213 of anti-screw collar 212.

Screw collar 210 extends circumferentially around drive shaft 94 and is threadingly engaged by drive shaft 94. Accordingly, when drive shaft 94 is rotated, screw collar 210 moves either towards chair seat 14 or towards lower enclosure member 204 depending upon a direction of rotation of motor 92 and drive shaft 94. Screw collar 210 includes a plurality of anti-twist channels (not shown) that extend lengthwise along screw collar 210. Screw collar 210 also includes a stop (not shown) adjacent an upper end (not shown) of screw collar 210. The screw collar upper end is coupled to upper enclosure upper end 208. The screw collar stop works in combination with drive shaft stop 102 (shown in FIG. 2) to limit a distance that upper enclosure member 202 may extend towards chair seat 14 from anti screw collar 212.

Anti-screw collar 212 also includes a plurality of anti-twist channels 216. Anti-twist collar channels 216 extend radially inward and mate with screw collar channels 214 to prevent screw collar 210 from rotating into anti-screw collar 212 when drive shaft 94 is rotated. Additionally, an upper key washer 218 extends circumferentially around anti-screw collar 212 and includes a plurality of projections (not shown) that mate with anti-twist collar channels 216 to prevent anti-screw collar 212 from rotating with respect to screw collar 210. As a result, when drive shaft 94 is rotated, screw collar 210 either moves upward and away from anti-screw collar 212 or moves towards anti-screw collar 212, depending upon the rotational direction of drive shaft 94. Furthermore, anti-screw collar 212 includes a stop flange adjacent screw collar 210 that prevents anti-screw collar 212 from over-rotating within anti-screw collar 212 and becoming stuck against anti-screw collar 212 when drive shaft 94 is rotated.

Lower enclosure member 204 includes an upper end (not shown) and a lower end 220. Lower enclosure member lower end 220 is tapered to be frictionally fit within base center socket 28 (shown in FIG. 1). More specifically, lower enclosure member lower end 220 includes a swivel base socket 222 that permits chair seat 14 to rotate with respect to chair base 12.

Lower enclosure member 204 also includes a lower screw collar 230 and an anti-screw collar 232. In one embodiment, screw collar 230 and anti-screw collar 232 have substantially non-circular profiles. In an alternative embodiment, screw collar 230 and anti-screw collar 232 have substantially circular profiles. Screw collar 230 extends circumferentially around drive shaft 94 and is threadingly engaged by drive shaft 94. Accordingly, when drive shaft 94 is rotated, screw collar 230 moves either towards chair base 12 or towards upper enclosure member 202 depending upon a direction of rotation of motor 92 and drive shaft 94. Screw collar 230 includes a plurality of anti-twist channels (not shown) that extend lengthwise along screw collar 230. Screw collar 230 also includes a stop (not shown) adjacent a lower end (not shown in FIG. 3) of screw collar 230. The screw collar lower end is coupled to lower enclosure lower end 220. The screw collar stop works in combination with a drive shaft stop (not shown) to limit a distance that lower enclosure member 204 may extend towards chair base 12 from anti screw collar 232.

Anti-screw collar 232 also includes a plurality of anti-twist channels 216. Anti-twist collar channels 216 extend radially inward and mate with the screw collar channels to prevent screw collar 230 from rotating into anti-screw collar 232 when drive shaft 94 is rotated. Additionally, a lower key washer 238 extends circumferentially around anti-screw collar 232 and includes a plurality of projections (not shown) that mate with anti-twist collar channels 216 to prevent anti-screw collar 232 from rotating with respect to screw collar 230. As a result, when drive shaft 94 is rotated, screw collar 230 either moves upward and away from anti-screw collar 232 or moves towards anti-screw collar 232, depending upon the rotational direction of drive shaft 94. Furthermore, anti-screw collar 232 includes a stop flange (not shown) adjacent screw collar 230 that prevents anti-screw collar 232 from over-rotating within anti-screw collar 232 and becoming stuck against anti-screw collar 232 when drive shaft 94 is rotated.

Upper and lower enclosure members 202 and 204, respectively, extend partially into a housing 240. Key washers 218 and 238 are between housing 220 and respective screw collars 210 and 230. More specifically, each key washer 218 and 238 is adjacent to an exterior surface 242 of housing 240 at a respective upper side 244 and lower side 246 of housing 240. Housing 240 also includes an inner surface 248 that defines a cavity 250. Upper and lower enclosure members 202 and 204, respectively, extend partially into housing cavity 250.

An upper and lower bushing 252 and 254, respectively, are each within housing cavity 250 and adjacent each respective key washer 218 and 238. In one embodiment, bushings 252 and 254 are rubber bushings. An upper and lower load bearing 256 and 258 are within housing cavity 250 and are adjacent each respective bushing 252 and 254. Bearings 256 and 258, bushings 252 and 254, and upper and lower enclosure members 202 and 204, respectively, are co-axially aligned.

Gear box 96 is coupled to drive shaft 94 within housing cavity 250 between load bearings 256 and 258. More specifically, gear box 96 is coupled substantially perpendicularly to drive shaft 94. Gear box 96 is also coupled to motor 92. A limit switch 260 is electrically coupled to electric motor 92 and automatically stops a flow of electric current to motor 92 when drive shaft 94 is rotated to a height 30 (shown in FIG. 1) that is near a pre-set fully extended position.

Housing 240 extends circumferentially around axis of symmetry 58 such that drive mechanism 90 is disposed within housing cavity 250. Drive mechanism 90 is coupled to height adjustment mechanism 200 and receives power from rechargeable battery cells housed within battery pack 144. Battery pack 144 is coupled to drive mechanism 90 with wires 146 which extend into housing 240 from a remote battery housing 270. Battery pack 144 is also coupled to a resistance sensing switch (not shown) which automatically stops a flow of electric current to motor 92 when a predetermined amount of resistance is induced within height adjustment mechanism 200 as chair seat height 30 (shown in FIG. 1) is adjusted. For example, the resistance sensing switch automatically stops a flow of electric current to motor 92 to prevent an occupant's legs (not shown) from being compressed between chair seat 14 and an underside (not shown) of a desk or table (not shown) as seat 14 is raised. Additionally, battery pack 144 is coupled to a control mechanism switch 272 that is accessible by an occupant sitting in chair seat 14. Control mechanism switch 272 permits selective adjustments of the chair seat height 30

(shown in FIG. 1) to be made with respect to chair base 12. In the exemplary embodiment, control mechanism switch 272 is coupled to a battery life indicator 274 that illuminates when the battery cells need recharging. In an alternative embodiment, battery life indicator 274 sounds an audible alarm when the battery cells need recharging.

During use, as drive shaft 94 is rotated in a first direction to raise chair seat 14 both upper and lower enclosure screw collars 210 and 230 simultaneously move away from housing 240. More specifically, upper enclosure member screw collar 210 is moved towards chair seat 14, while lower enclosure member screw collar 230 is moved towards chair base 12. Reversing an operation of motor 92, reverses a rotation of drive shaft 94, and screw collars 210 and 230 move towards each other and towards housing 240 to lower chair seat 14.

Figure 4:
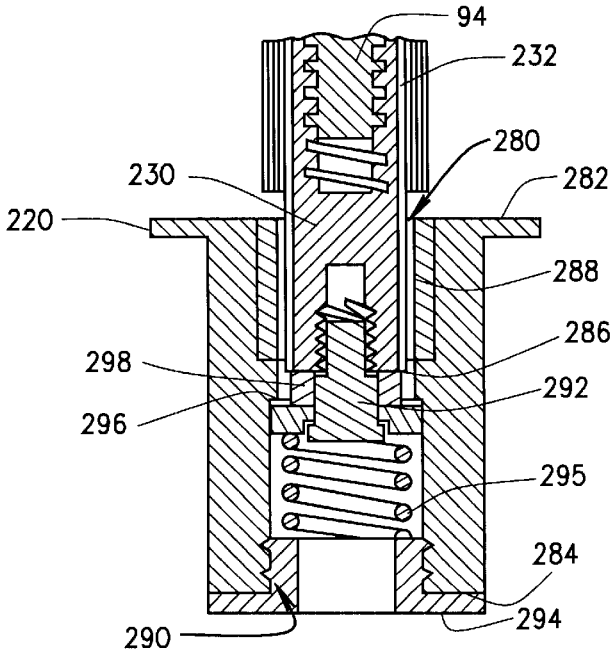
FIG. 4 is an enlarged cross-sectional view of the height adjustment mechanism shown in FIG. 3 and taken along line 4—4.

FIG. 4 is a cross-sectional view of swivel base socket 220. Swivel base socket 220 is hollow and includes an opening 280 that extends from an upper side 282 of swivel base socket 220 to a lower side 284 of swivel base socket 220. Opening 280 is sized to receive screw collar 230. More specifically, a lower end 286 of screw collar 230 extends into opening 280 and is circumferentially surrounded by an insert 288. In one embodiment, insert 288 is a Teflon® insert. Swivel base socket 220 is sized to provide side loading resistance to height adjustment mechanism 200.

Screw collar lower end 286 includes a threaded opening 290 sized to receive a fastener 292 used to secure screw collar to swivel base socket 220. In one embodiment, fastener 292 is a shoulder screw. Fastener 292 extends through a bushing 294 inserted into swivel base opening lower side 284. Bushing 294 includes a shock absorption spring 295 that is biased against fastener 292. Fastener 292 also extends through a hardened washer 296 and through a ball bearing assembly 298 positioned between bushing 294 and screw collar lower end 286.

Figure 5:
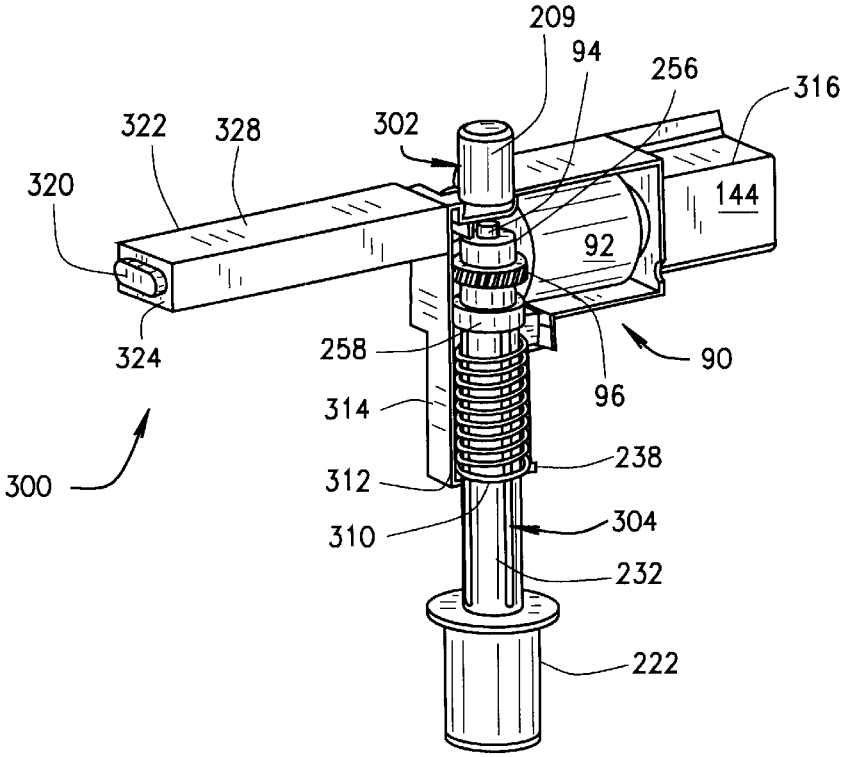
FIG. 5 is a partial cut-away side view of an alternative embodiment of a height adjustment mechanism that may be used with the chair shown in FIG. 1.

FIG. 5 is partial cut-away side view of an alternative embodiment of a height adjustment mechanism 300 that may be used with chair 10 (shown in FIG. 1). Height adjustment mechanism 300 is substantially similar to height adjustment mechanism 200 shown in FIGS. 3 and 4, and components in height adjustment mechanism 300 that are identical to components of height adjustment mechanism 200 are identified in FIG. 5 using the same reference numerals used in FIGS. 3 and 4. Accordingly, height adjustment mechanism 300 includes drive mechanism 90, including electric motor 92, drive shaft 94, and gear box 96. In addition, height adjustment mechanism 300 also includes an upper enclosure member 302 telescopically coupled co-axially to lower enclosure member 304. Upper and lower enclosure members 302 and 304, respectively are substantially similar to upper and lower enclosure members 202 and 204.

Upper enclosure member upper end 208 includes taper end 209, and lower enclosure member 304 includes anti-screw collar 232 and lower screw collar 230 (shown in FIGS. 3 and 4). Lower enclosure member lower end 220 also includes swivel base socket 222 and key washer 238. A stroke resistance spring 310 circumferentially surrounds lower enclosure member 304 and is between key washer 238 and a lower side 312 of a housing 314.

Gear box 96 is coupled to drive shaft 94 between bearings 256 and 258. More specifically, gear box 96 is coupled substantially perpendicularly to drive shaft 94 adjacent an upper end 316 of drive shaft 94. Limit switch 260 is electrically coupled to electric motor 92 and automatically stops a flow of electric current to motor 92 when drive shaft 94 is rotated to a height (not shown) that is near a pre-set fully extended position.

Housing 314 is substantially similar to housing 240 (shown in FIGS. 3 and 4) and extends circumferentially around axis of symmetry 58 such that drive mechanism 90 is housed within housing 314. Drive mechanism 90 is coupled within height adjustment mechanism 300 to receive power from battery pack 144. Battery pack 144 is not housed within housing 314, but is instead removably coupled to drive mechanism with wires (not shown) which extend into housing 314 from a separate battery housing 316. Battery pack 144 is also coupled to a resistance sensing switch (not shown) which automatically stops a flow of electric current to motor 92 when a pre-determined amount of resistance is induced into height adjustment mechanism 300 as chair seat height 30 (shown in FIG. 1) is adjusted. For example, the resistance sensing switch automatically stops a flow of electric current to motor 92 to prevent an occupant's legs (not shown) from being compressed between chair seat 14 and an underside (not shown) of a desk or table (not shown) as seat 14 is raised. Additionally, battery pack 144 is coupled to a control mechanism switch 320 that is accessible by an occupant sitting in chair seat 14. Control mechanism switch 320 permits selective adjustments of chair seat height 30 to be made with respect to chair base 12. In an alternative embodiment, battery pack 144 is coupled to motor 92 on an opposite side of gear box 96 than motor 92 is positioned.

Control switch 320 is coupled to housing 314. More specifically, housing 314 includes an arm 322 that extends radially outward from axis of symmetry 58, and is opposite electric motor 92 and battery pack 144. Control switch 320 is coupled to an end 324 of arm 322. In an alternative embodiment, housing 314 does not include arm 322 and control switch 320 is positioned remotely from housing 314 and height adjustment mechanism 300. Because gear box 96 is coupled substantially perpendicularly to drive shaft 94 at drive shaft upper end 316, upper enclosure member taper end 209 is adjacent an upper surface 328 of housing 314.

During use, as drive shaft 94 is rotated in a first direction to raise chair seat 14, lower enclosure screw collar 230 is rotated by drive shaft 94 and extends from housing 314 towards chair base 12. Reversing an operation of motor 92, reverses a rotation of drive shaft 94, and screw collars 230 moves towards housing 314, thus lowering a relative position of chair seat 14.

Figure 6:
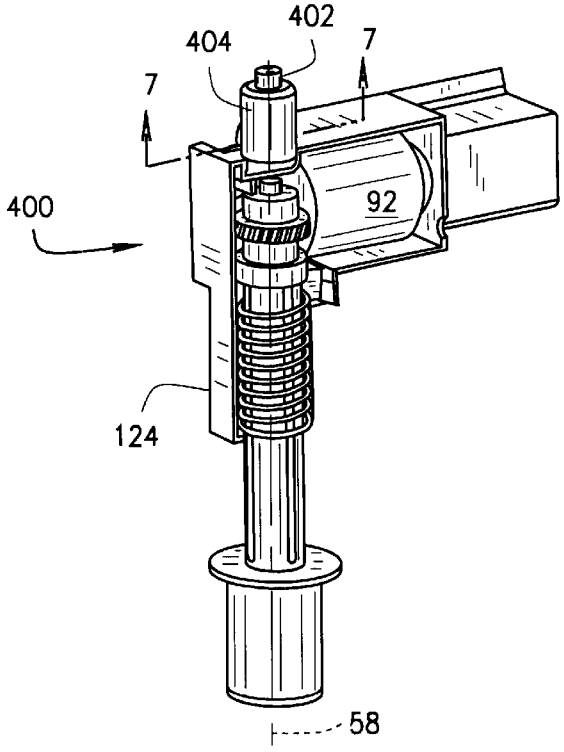
FIG. 6 is a partial cut-away side view of an alternative embodiment of a height adjustment mechanism that may be used with the chair shown in FIG. 1.
Figure 7:
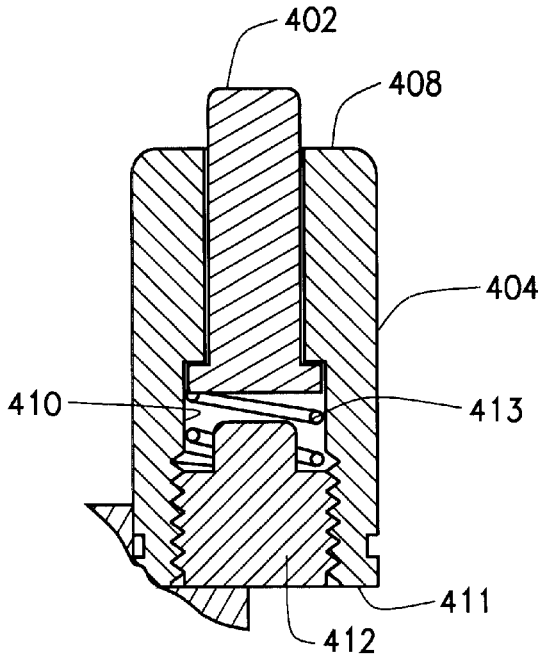
FIG. 7 is an enlarged cross-sectional view of the height adjustment mechanism shown in FIG. 6 and taken along line 7—7.

FIG. 6 is a partial cut-away side view of an alternative embodiment of a height adjustment mechanism 400 that may be used with chair 10 (shown in FIG. 1). FIG. 7 is an enlarged cross-sectional view of height adjustment mechanism 400 taken along line 7—7. Height adjustment mechanism 400 is substantially identical to height adjustment mechanism 300 shown in FIG. 5, and components in height adjustment mechanism 400 that are identical to components of height adjustment mechanism 300 are identified in FIGS. 6 and 7 using the same reference numerals used in FIG. 5. More specifically, height adjustment mechanism 400 does not include control switch 320, but rather upper enclosure member upper end 208 includes an actuation switch 402 that is formed integrally with a taper end 404.

Upper enclosure member taper end 404 is hollow and includes an opening 406 that extends from an upper surface 408 of taper end 404 to an internal surface 410 of taper end 404. Taper end 404 is tapered and is co-axially aligned with respect to axis of symmetry 58. A lower side 411 of taper end 404 is threaded and couples to a standard push button switch 412 included with known pneumatic cylinders, such as are commercially available from Stabilius, Colmar, Pa. A spring 413 is biased between push button switch 412 and actuation switch 402.

During use, when actuation switch 402 is depressed, spring 413 is depressed into push button switch 412. Accordingly, because push button switch 412 is electrically coupled to drive mechanism 90, when button switch 412 is depressed, electric motor 92 is activated, and remains activated as long as actuation switch 402 remains depressed. When actuation switch 402 is released and then re-depressed, motor 92 reverses rotation, and chair seat 14 (shown in FIG. 1) is moved in an opposite direction.

Figure 8:
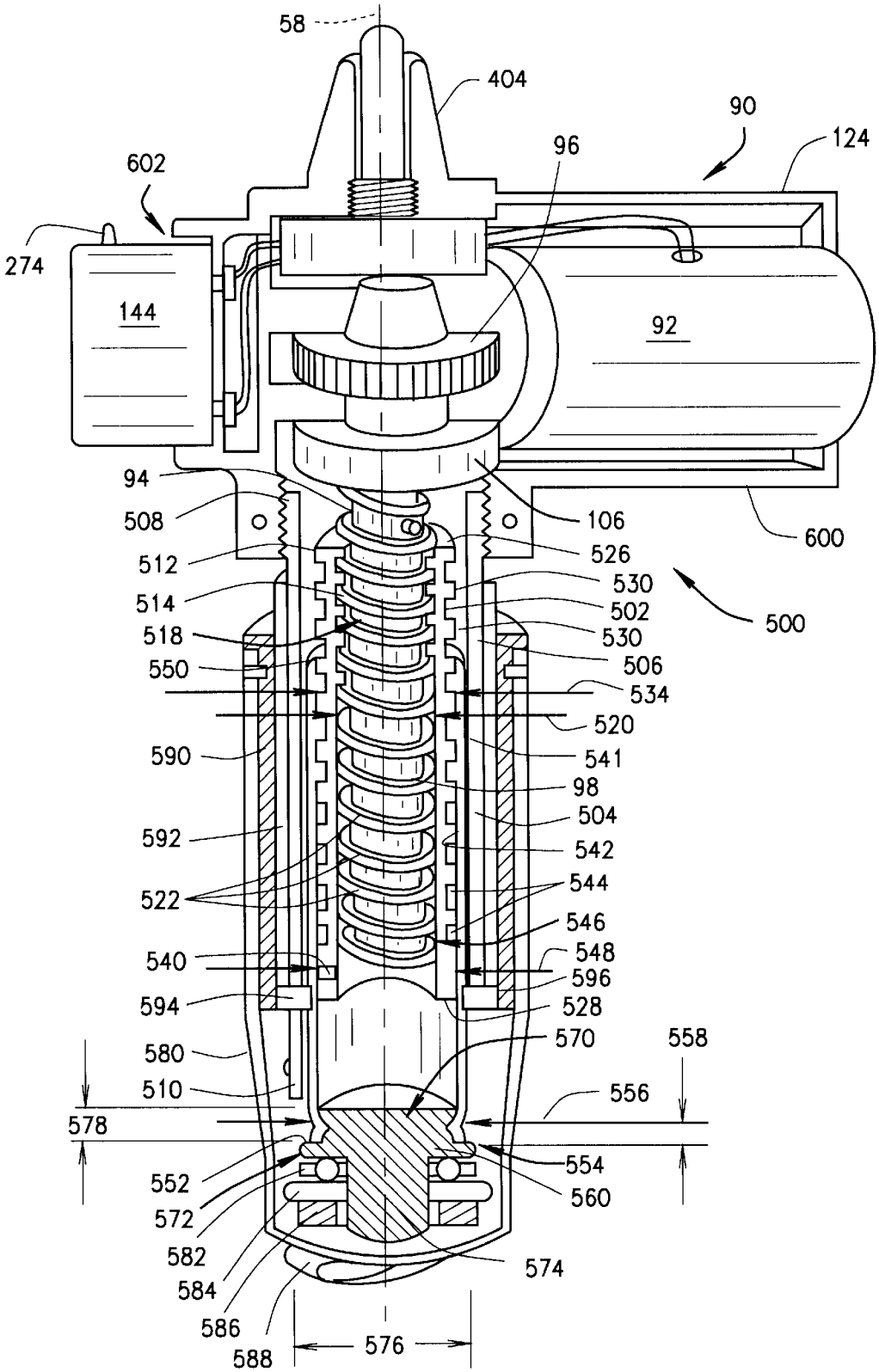
FIG. 8 is a cut-away side view of an alternative embodiment of a height adjustment mechanism that may be used with the chair shown in FIG. 1.

FIG. 8 is a cut-away side view of an alternative embodiment of a height adjustment mechanism 500 that may be used with chair 10 (shown in FIG. 1). Height adjustment mechanism 500 is substantially similar to height adjustment mechanism 400 shown in FIGS. 6 and 7, and to height adjustment mechanism 40 shown in FIG. 2, and components in height adjustment mechanism 500 that are identical to components of height adjustment mechanisms 40 and 400 are identified in FIG. 8 using the same reference numerals used in FIGS. 2, 6, and 7. Accordingly, height adjustment mechanism 500 includes taper end 404 including actuation switch 402, drive mechanism 90, and load bearing 106.

Height adjustment mechanism 500 also includes an upper enclosure member 502 telescopically coupled to a lower enclosure member 504. More specifically, lower enclosure member 504 is coupled substantially co-axially to upper enclosure member 502 such that upper enclosure member 502 telescopes into lower enclosure member 504. Upper enclosure member 502 is coupled between chair seat 14 (shown in FIG. 1) and lower enclosure member 504. Lower enclosure member 504 is coupled between upper enclosure member 502 and chair base 12. In one embodiment, upper enclosure member 502 has a substantially circular cross-sectional profile.

Upper enclosure member 502 includes a hollow guide sleeve 506, an upper end 508, and a lower end 510. In addition, upper enclosure member 502 includes an outer surface 512 and an inner surface 514. Guide sleeve 506 provides sideload resistance to height adjustment mechanism 500. In addition, guide sleeve 506 includes a plurality of anti-twist channels (not shown) that extend substantially length wise along outer surface 512.

Upper enclosure member inner surface 514 defines a cavity 518. Upper enclosure member cavity 518 has a diameter 520 measured with respect to inner surface 514, and is sized to receive drive shaft 94 therein. More specifically, upper enclosure member inner surface 514 includes a plurality of threads 522 that extend radially inward from inner surface 514 between an upper end 526 of upper enclosure member 502 and a lower end 528 of upper enclosure member 502. As drive shaft 94 is rotated into upper enclosure member cavity 518, drive shaft threads 98 engage upper enclosure member threads 522 and threadingly couple upper enclosure member 502 to drive shaft 94.

Upper enclosure member outer surface 512 includes a plurality of threads 530 that extend radially outward from outer surface 512 between upper enclosure member upper and lower ends 526 and 528, respectively. Upper enclosure member 502 has an outer diameter 534 measured with respect to outer surface 512. Upper enclosure member 502 also includes a lower stop 540 adjacent to upper enclosure member lower end 528.

Lower enclosure member 504 is hollow and includes an outer surface 541 and an inner surface 542 including a plurality of threads 544 which extend radially inward from inner surface 542. Inner surface 542 defines a cavity 546 that has a diameter 548 measured with respect to inner surface 542. Lower enclosure member cavity diameter 548 is larger than upper enclosure member outer diameter 534. Accordingly, lower enclosure member cavity 546 is sized to receive upper enclosure member 502 therein. More specifically, as upper enclosure member 502 is received within lower enclosure member cavity 546, lower enclosure member threads 544 engage upper enclosure member threads 530, such that lower enclosure member 504 is threadingly coupled to upper enclosure member 502.

Lower enclosure member 504 has an upper end 550 and a lower end 552. Lower enclosure member upper end 550 is threadingly coupled to upper enclosure member 502. Lower enclosure member lower end 552 is tapered to form a necked portion 554 that has an inner diameter 556. As a result, lower enclosure member necked portion diameter 556 is smaller than lower enclosure member cavity diameter 548. Lower enclosure member outer surface 541 includes a plurality of anti-twist channels (not shown) that extend between upper and lower ends 550 and 552, respectively.

Lower enclosure member necked portion 554 is a distance 558 from lower enclosure member lower end 552, and is sized to receive a fitting 560. More specifically, because lower enclosure member necked portion diameter 556 is smaller than lower enclosure member cavity diameter 548, when fitting 560 is inserted into lower enclosure member cavity 546 through lower enclosure member lower end 552, fitting 560 must be forcibly compressed to be fully inserted into lower enclosure member 504. More specifically, as fitting 560 is inserted into lower enclosure member lower end 552, necked portion 554 induces a compressive force into fitting 560. In one embodiment, fitting 560 is press fit into lower enclosure member lower end 552.

Fitting 552 includes a cavity portion 570, a shoulder portion 572, and a coupling portion 574. Fitting cavity portion 570 is inserted into lower enclosure member lower end 552 through lower enclosure member necked portion 554. Fitting shoulder portion 570 has an outer diameter 576 that is larger than lower enclosure member inner diameter 556, and accordingly, fitting shoulder portion 570 limits a depth 578 that fitting cavity portion 570 is inserted into lower enclosure member 504.

Fitting coupling portion 574 extends radially outwardly from fitting shoulder portion 572. More specifically, fitting coupling portion 574 is co-axially aligned with respect to axis of symmetry 58 and extends substantially perpendicularly from fitting shoulder portion 572 to couple with an outer housing 580 included with a known pneumatic cylinder, such as are commercially available from Stabilius, Colmar, Pa. More specifically, fitting coupling portion 574 extends from fitting shoulder portion 572 through a bearing 582, a hardened washer 584, and a rubber bushing 586 to a cylinder clip 588. Cylinder clip 588 is known in the art and couples fitting 552 to housing 580. In one embodiment, bearing 582 is a ball thrust bearing.

Housing 580 is known in the art and extends circumferentially around height adjustment mechanism 500. More specifically, housing 580 extends circumferentially around upper enclosure member guide sleeve 506. An insert guide 590 and an outer guide sleeve 592 also extend circumferentially around upper enclosure member guide sleeve 506. Outer guide sleeve 592 is between insert guide 590 and upper enclosure member guide sleeve 506, and insert guide 590 is between outer guide sleeve 592 and housing 580.

Outer guide sleeve 592 provides additional sideloading support to height adjustment mechanism 500 and includes a plurality of sleeve pins 594 that extend radially inward from a lower end 596 of outer guide sleeve 592. More specifically, upper enclosure member guide sleeve 506 includes channels (not shown) that extend circumferentially around guide sleeve 506 adjacent upper enclosure member guide sleeve lower end 510. The upper enclosure member guide sleeve channels are sized to receive outer guide sleeve pins 594, and thus permit height adjustment mechanism 500 and chair seat 14 to rotate relative to chair base 12. In addition, insert guide 590 includes anti-rotational channels (not shown) which enable insert guide 590 to mate with outer guide sleeve 592 to prevent outer guide sleeve 592 from rotating with respect to housing 580. Furthermore, a plurality of set screws 598 extend through housing 580 into insert guide 590.

A housing 600 extends circumferentially around axis of symmetry 58 such that upper enclosure member 502, lower enclosure member 504, and drive mechanism 90 are enclosed within housing 600. In one embodiment, housing 600 is fabricated from cast metal. In another embodiment, housing 600 is fabricated from plastic. In addition, housing 504 includes a receptacle 602 formed therein opposite motor 92 for receiving battery pack 144 therein. In one embodiment, taper end 404 is formed unitarily with housing 600. In another embodiment, receptacle 602 has a conical cross-sectional profile to facilitate receiving battery pack 144 therein.

Figure 9:
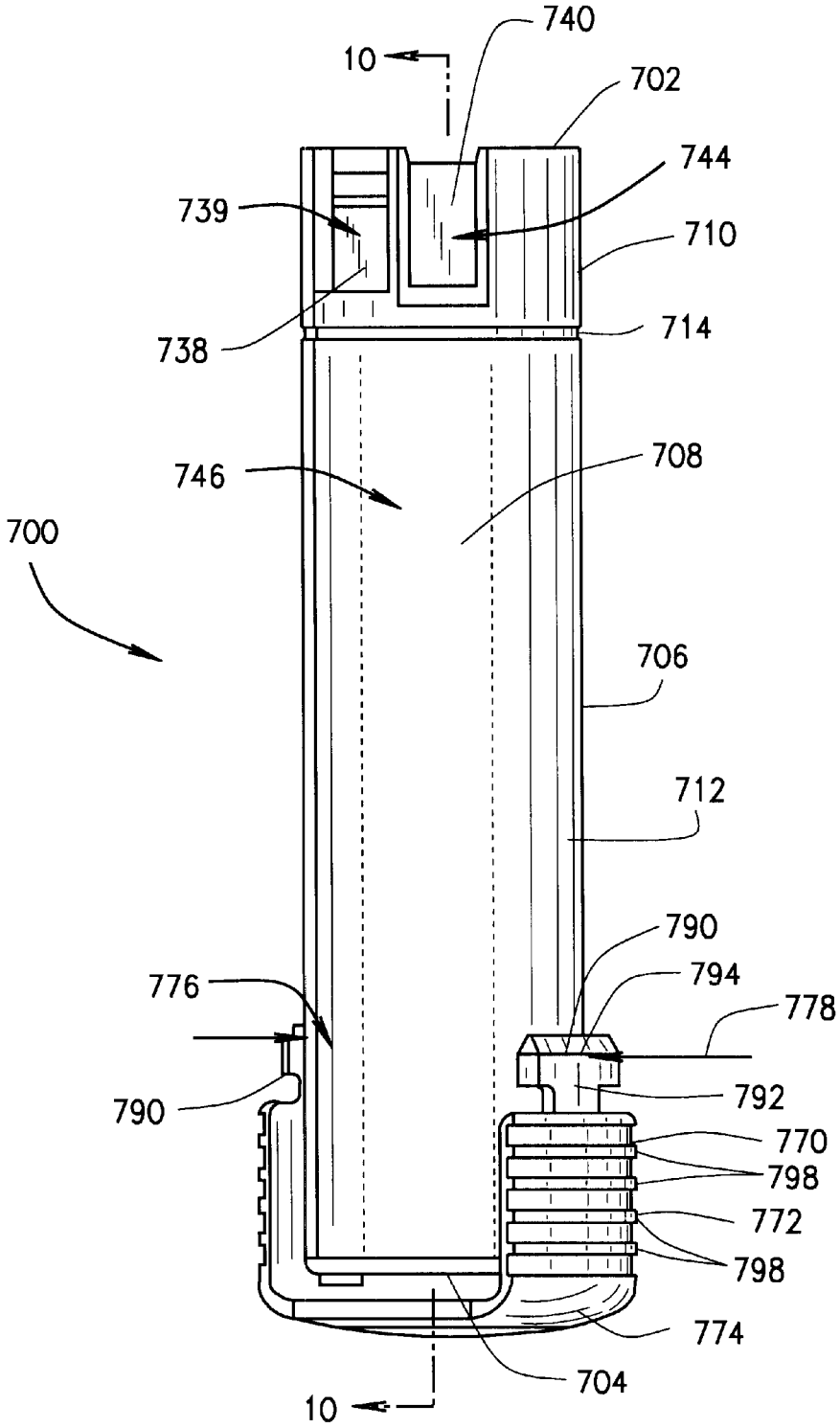
FIG. 9 is a side view of a battery pack that may be used with the chair shown in FIG. 1.
Figure 10:
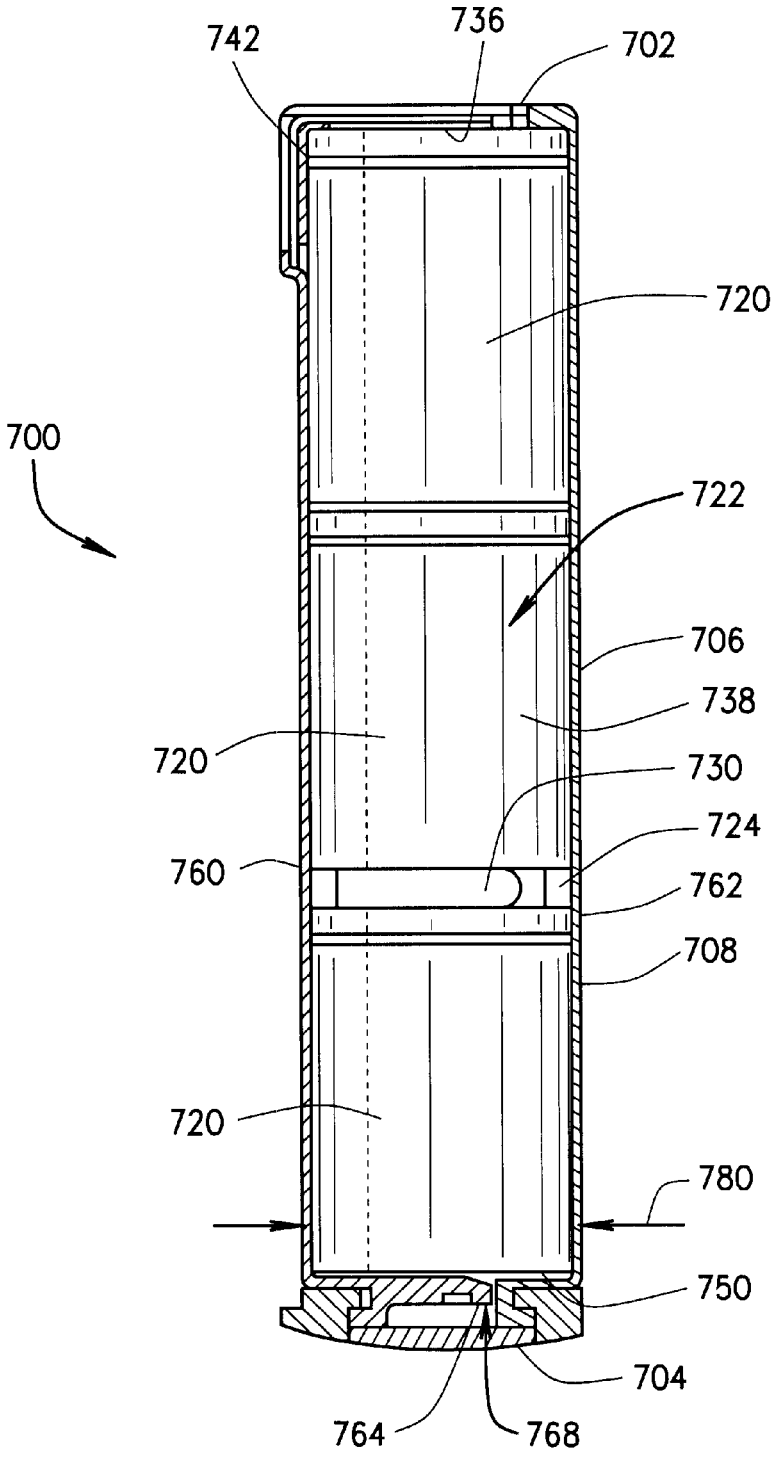
FIG. 10 is cross-sectional view of the battery pack shown in FIG. 9 taken along line 10—10.

FIG. 9 is a side view of an exemplary embodiment of a battery pack 700 that may be used with adjustable chair 10 to provide power to a height adjustment mechanism, such as height adjustment mechanisms 40, 200, 300, 400, and 500 (shown respectively in FIGS. 2, 3, 5, 6, and 8). FIG. 10 is cross-sectional view of battery pack 700 taken along line 10—10 (shown in FIG. 9). Battery pack 700 has a first end 702, a second end 704, and a body 706 extending therebetween. A housing 708 extends from battery pack first end 702 to battery pack second end 704. In one embodiment, battery pack housing 708 has a substantially elliptical cross-sectional profile. Alternatively, battery pack housing 708 has a non-elliptical cross-sectional profile. More specifically, housing 708 includes an upper portion 710 and a lower portion 712 separated by a gap 714 extending around battery pack 700. In one embodiment, housing 708 is fabricated from molded plastic. In the exemplary embodiment, housing lower portion 712 is covered with shrink wrap tubing (not shown).

A plurality of battery cells 720 are housed within a cavity 722 defined within battery pack housing 708. In one embodiment, battery pack 700 includes only one battery cell 720. More specifically, battery cells 702 are axially-aligned in an end-to-end relationship within housing 708 to form an integrated battery pack 700. In the exemplary embodiment, three battery cells 720 are housed within battery pack housing 708. Alternatively, battery pack housing 708 may house more or less than three battery cells 720. A plurality of spacer rings 724 extend circumferentially within battery pack housing 708 to separate adjacent battery cells 720 such that adjacent battery cells 720 are electrically coupled.

A plurality of fusible elements 730 are positioned radially inward from each spacer ring 724. Adjacent battery cells 720 are electrically coupled together through fusible elements 730. Fusible elements 730 form an open circuit that prevents electrical current from flowing between adjacent battery cells 720 when a preset current flow is detected within fusible elements 730. More specifically, when fusible elements 730 open, excessive electrical current drains from battery cells 720 are stopped, thus reducing potential damage to battery pack 700 or other components, such as the height adjustment mechanism.

Each battery cell 720 includes a positive terminal 736 and an outer casing 738 that is the negative terminal for each battery cell 720. An opening 739 in battery pack housing 708 exposes a portion of battery cell outer casing 738. Additionally, battery pack 700 has a positive terminal 740 and a negative terminal 742. More specifically, an opening 744 extending through battery pack housing upper portion 710 exposes battery pack positive terminal 740. Opening 744 extends along a side 746 of battery pack housing upper portion 710 continuously across battery pack upper portion first end 702 to a center (not shown in FIGS. 9 and 10) thereof. Battery pack housing 708 provides insulation that prevents positive terminal 740 from contacting 738 of a battery cell 720 adjacent battery pack first end 702. Thus positive terminal 740 may be accessed continuously from the center of battery pack 700 to a side 746 of battery pack 700.

Battery pack negative terminal 742 extends from a base 750 of a battery cell 720 that is adjacent battery pack second end 704 to battery pack housing upper portion 710. Negative terminal 742 is insulated from battery cell casings 738 by housing 708, such that additional insulating tape is not required. Furthermore, negative terminal 742 is offset approximately ninety degrees from battery pack positive terminal 740. In one embodiment, battery pack 700 provides approximately twelve volts of power to adjustable chair 10. In another embodiment, battery pack 700 provides greater than twelve volts of power to adjustable chair 10. Alternatively, battery pack 700 is sized to provide sufficient power to adjustable chair for operation of controls (not shown) used in adjusting chair 10.

In the exemplary embodiment, battery pack housing 708 is formed of two portions 760 and 762 coupled together in a clamshell-type configuration. Portions 760 and 762 couple together around battery cells 720 to form an integrated battery pack 700. More specifically, housing portion 760 includes a projection 764 that extends radially from housing portion 760. Projection 764 is inserted into a mating slot 768 formed within housing portion 762. Housing upper portion 710 also includes a projection and slot combination (not shown in FIGS. 9 and 10) which work in combination with housing lower portion projection and slot 764 and 768, respectively, to couple housing portions 760 and 762 together.

A locking cap 770 is coupled to battery pack housing second end 704. More specifically, locking cap 770 includes a sidewall 772 extending circumferentially and substantially perpendicularly from a base 774. Sidewall 772 and base 774 define a cavity 776 that has a diameter 778 measured with respect to sidewall 772. Locking cap cavity diameter 778 is slightly larger than an outer diameter 780 of battery pack housing 708 at battery pack second end 704. Accordingly, battery pack housing 708 is received within locking cap cavity 776. Locking cap 770 ensures battery pack housing portions 760 and 762 remain coupled together.

A plurality of locking tabs 790 extend from locking cap 770. In the exemplary embodiment, locking tabs 790 are T-shaped. Locking tabs 790 are beveled and are received within mating locking slots (not shown) formed within height adjustment mechanism housing 124 (shown in FIGS. 2, 3, 5, 7, and 8). More specifically, each locking tab 790 includes a first body portion 792 and a second body portion 794. First body portion 792 extends from locking cap 770 linearly towards battery pack housing upper portion 710, and second body portion 794 extends substantially perpendicularly from first body portion 792 to form a T-shape. Accordingly, the mating locking slots formed within chair 10 are also T-shaped in the exemplary embodiment.

Locking tabs 790 removably couple battery pack 700 to height adjustment mechanism housing 124. More specifically, because locking tabs 790 may only be received within the mating locking slots in one orientation, locking tabs 790 also ensure that battery pack 700 is coupled to adjustable chair 10 in a proper alignment, such that electrical connections between battery pack 700 and chair 10 are completed.

In the exemplary embodiment, locking cap 770 also includes a plurality of raised ridges 798 to provide a surface for a user to grasp during removal and installation of battery pack 700 to chair 10. In one embodiment, chair 10 includes an integrally formed battery charger (not shown) that is selectively operable to recharge battery cells 720. In another embodiment, battery pack 700 includes an integrally formed battery charger (not shown) that is selectively operable after battery pack 700 is uncoupled from chair 10.

Figure 11:
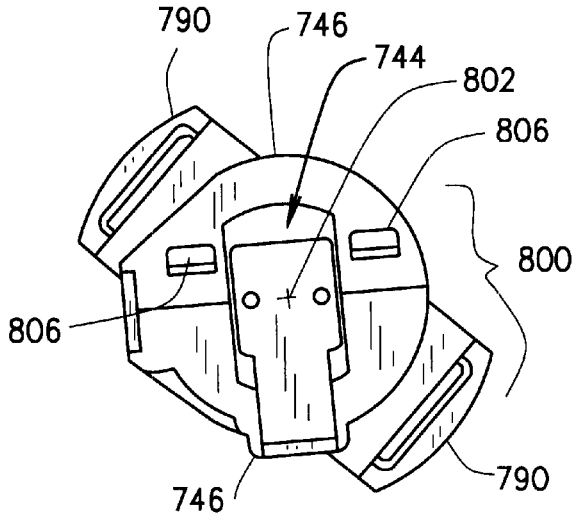
FIG. 11 is a top view of the battery pack shown in FIG. 9.

FIG. 11 is a top view of battery pack 700. Battery pack positive terminal 740 is exposed through housing opening 744. Opening 744 extends along battery pack housing upper portion side 746 continuously across a portion 800 of battery pack upper portion first end 702. More specifically, opening 744 extends from battery pack housing upper portion side 746 through a center 802 of battery pack 700 towards an opposite side 746 of battery pack upper portion 710. Housing upper portion 710 also includes a pair of projections 806 that extend through mating slots 808 in housing upper portion 710. Housing upper portion projections and slots 806 and 808, respectively, work in combination with housing lower portion projection and slot 764 (shown in FIG. 10) and 768 (shown in FIG. 10), respectively, to couple housing portions 760 and 762 together.

Battery pack negative terminal 742 is offset approximately ninety degrees from battery pack positive terminal 740. Accordingly, battery pack positive terminal 740 may be electrically coupled within chair 10 (shown in FIG. 1) from battery pack side 746 or battery pack end 702. Furthermore, in the exemplary embodiment, battery pack negative terminal 742 may be electrically coupled within chair 10 from battery pack side 746.

Locking cap locking tabs 790 extend radially outward from locking cap 770 and from battery pack housing 708. More specifically, locking tabs 790 removably couple battery pack 700 to chair 10. Because locking tabs 790 may only be received within the mating locking slots in one orientation, locking tabs 790 also ensure that battery pack 700 is coupled to adjustable chair 10 in a proper alignment, such that electrical connections between battery pack 700 and chair 10 are completed. In the exemplary embodiment, locking cap 770 also includes a plurality of raised ridges 794 to provide a surface for a user to grasp during removal and installation of battery pack 700 to chair 10.

While the invention has been described in terms of various specific embodiments, those skilled in the art will recognize that the invention can be practiced with modification within the spirit and scope of the claims.

What is claimed is:

1. A power kit assembly for a chair including a height adjustment mechanism including a limit switch configured to limit an amount of movement of the height adjustment mechanism, said power kit assembly comprising:

an electric motor coupled to the height adjustment mechanism; and a battery pack electrically coupled to said electric motor and to the limit switch, said battery pack configured to supply power to said electric motor for adjusting a height of the chair with the height adjustment mechanism, said battery pack comprising at least one battery cell, and a housing, said battery cell extending from a first end of said battery pack to a second end of said battery pack, said housing defining a cavity, said battery pack within said housing cavity.

2. A power kit assembly in accordance with claim 1 wherein said battery pack battery cell is rechargeable.

3. A power kit assembly in accordance with claim 1 wherein said battery pack battery cell comprises at least one of a lead acid battery, a nickel metal hydride battery, a nickel cadmium battery, a lithium ion battery, and a lithium ion polymer battery.

4. A power kit assembly in accordance with claim 1 wherein said battery pack housing substantially cylindrical.

5. A power kit assembly in accordance with claim 1 wherein the height adjustment mechanism includes a housing, said electric motor within the height adjustment mechanism housing, said battery pack removably coupled to the height adjustment mechanism housing.

6. A power kit assembly in accordance with claim 5 wherein said battery pack further comprises at least one locking tab configured to secure said battery pack to the height adjustment mechanism housing.

7. A power kit assembly in accordance with claim 5 wherein the battery pack further comprises a housing, said electric motor within the height adjustment mechanism housing, said battery pack housing within the height adjustment mechanism housing.

8. A power kit assembly in accordance with claim 1 wherein said battery pack coupled to a battery life indicator configured to detect an amount of useful life of said battery pack battery cell.

9. A power kit assembly in accordance with claim 8 wherein said battery life indicator provides at least one of an audible alarm and a visual alarm.

10. A power kit assembly in accordance with claim 1 wherein a rotation of said electric motor is reversible, such that said electric motor further configured to increase and decrease a height of the chair relative to a chair base.

* * * * *